US005227119A

United States Patent [19]

Zalner et al.

[11] Patent Number: 5,227,119

[45] Date of Patent: Jul. 13, 1993

[54] SPRAY-COOLED FURNACE COVER

[75] Inventors: Albert J. Zalner, Pittsburgh; Otto H. Metelmann, Wexford, both of Pa.

[73] Assignee: Mannesmann Aktiengesellschaft, Dusseldorf, Fed. Rep. of Germany

[21] Appl. No.: 856,447

[22] Filed: Mar. 24, 1992

[51] Int. Cl.[5] ..... C21C 1/00

[52] U.S. Cl. ..... 266/241; 373/74

[58] Field of Search ..... 266/200, 241, 242, 190; 373/74

[56] References Cited

U.S. PATENT DOCUMENTS

| | | | |
|---|---|---|---|
| 4,715,042 | 12/1987 | Heggart et al. | 373/74 |
| 4,789,991 | 12/1988 | Metalmann et al. | 373/74 |
| 4,815,096 | 3/1989 | Barwell | 373/74 |
| 4,849,987 | 7/1989 | Miner, Jr. et al. | 373/74 |

*Primary Examiner*—Scott Kastler

*Attorney, Agent, or Firm*—Schweitzer Cornman & Gross

[57] ABSTRACT

A spray-cooled furnace cover or roof from which the coolant is removed by gravity flow without the use of any pumps. The roof has lower coolant consumption than roofs requiring Venturi pumps to remove water.

10 Claims, 4 Drawing Sheets

Fig.2.1
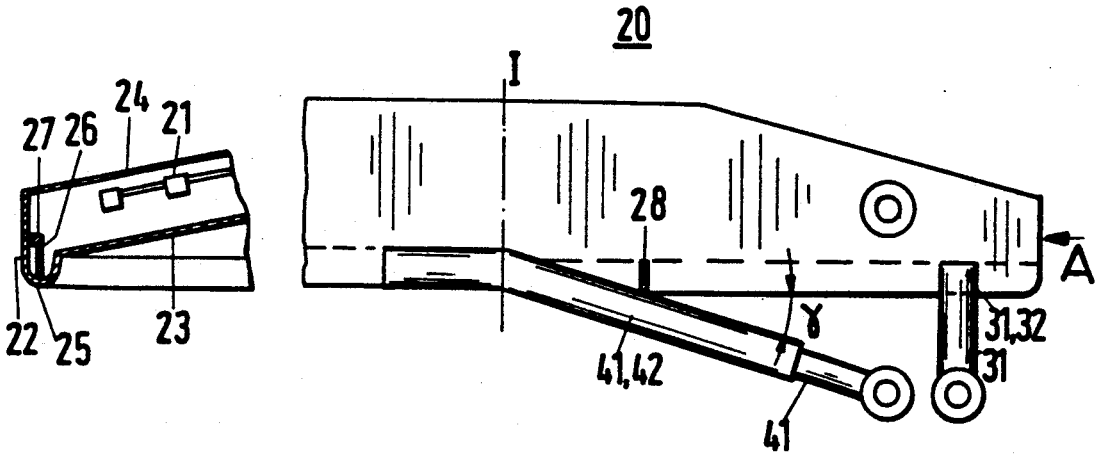
Fig.2.2
(A)
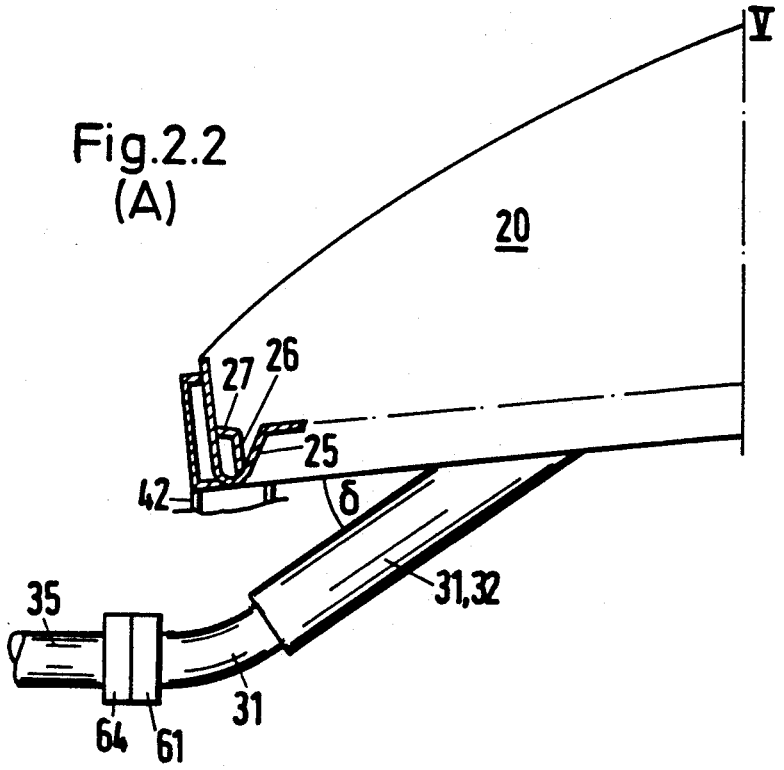

SPRAY-COOLED FURNACE COVER

FIELD OF THE INVENTION

The present invention relates to a spray-cooled cover or roof for a tiltable, metallurgical vessel such as an electric arc furnace.

BACKGROUND OF THE INVENTION

Such covers or roofs are typically installed on the furnace vessel and remain in place during the entire operation, including the tilting movements of the vessel for tapping and slagging. In certain phases of the operation, for example, when the vessel is being charged, the cover or roof is lifted from the vessel and swung to the side. Thus a furnace roof is subjected to lifting, swiveling, and tilting during the operation of the furnace.

Particular importance is accorded to the supply and discharge of coolant to and from the spray-cooled roofs when these are in various positions in the cycle of operation. The U.S. Pat. No. 4,715,042 discloses a spray-cooled cover, for which the coolant is drawn off by means of venturi pumps. In practical operations, this type of pump has been incapable of drawing off very large amounts of coolant. In certain instances, water collects in the cover so that, instead of spray cooling, normal water cooling exists, leading to the negative results of overheating of the roof elements in the affected area. In addition, this roof uses large quantities of water.

The U.S. Pat. No. 4,789,991 of Mannesmann AG discloses a spray-cooled roof, for which disc pumps are used, which pumps are able to draw off larger amounts of water. Moreover, even after such pumps run dry, that is, when there is a break in the continuity of the water on the suction side, they are suitable nevertheless for starting up operations once again. These pumps are connected by means of hoses with the spray-cooled cover and thus permit the roof to be tilted. However for swiveling the cover, it is necessary to disconnect these hoses from the cover by means of rapid action (quick-disconnect) hose couplings. It should be mentioned that, for the known methods of supplying and discharging coolant, not only are pumps required for the spray water but separately operated pumps are also required for drawing off the coolant.

OBJECT OF THE INVENTION

It is an object of the present invention to provide a new and improved spray-cooled roof of the aforementioned general type, for which coolant can be supplied and carried away reliably in any position of the cover throughout the cycle of furnace operation, in a structurally simple manner without the use of pumps and without disconnection of the coolant exhaust hoses, and requiring lower water consumption than previous designs.

SUMMARY OF THE INVENTION

The objectives of the invention are accomplished in accordance with the principles of the invention by arranging the geometry of the roof such that the coolant may be removed entirely under the influence of gravity and without pumps to remove coolant.

The coolant is supplied to the cover by pumps and distributed on the underside of the cover by spray jets. It collects in a catchment that is provided at the edge of the cover and exits through two discharge pipelines, which run parallel to one another over the greater part of their length, and which terminate at a common transfer to the factory network. The transfer station is at a sufficient distance below the lowest possible operating point of the cover so that a reliable, gravity-induced drainage of the coolant is constantly ensured. It is therefore no longer necessary to use pumps to exhaust coolant from the roof. Due to the unique design, the new roof has lower water consumption than roofs requiring Venturi pumps to remove water. Since no pumps of any kind are required, the new roof is also intrinsically safer than previously known roofs from an explosion hazard standpoint.

The coolant in the cover is drawn off by gravity flow at two places, namely at the intersection of the center line of the cover with the edge region proximate to the tap hole and at the intersection of the center line of the cover with the edge proximate to the slag door.

For this purpose, a coolant conduit is provided within the catchment that is provided in the outer edge of the cover. This nozzle-shaped tunnel communicates between the tapping or slag tapping vertex at one end and with the discharge pipelines at the other end. In the region of the cover, these outlet pipes are constructed as square pipes, since in this way equality is achieved between the bottom and the vertex of the catchment and a reliable run off of the coolant is possible.

The square pipe, which serves for the drainage of the coolant from the area of the tapping side, is disposed parallel to the tilting axis in the region of the cover vertex proximate the tapping hole. Thus, it is possible to have a reliable discharge of the coolant, which collects in the area of the vertex of the cover when the cover is in the tilted position for "tapping".

The coolant outlet line, which is connected with the cover vertex proximate the tapping shutter, is constructed as a square pipe, so that it is box-shaped in the region in which it is connected with the edge of the roof. The center of this box intersects the tilting axis. The box extends in the direction of the tapping side of the cover and is thus suitable for discharging coolant from the tapping side of the roof vertex over a wide range of tilting angles of the roof. Away from the tapping side, the square pipe is disposed at an angle to the transfer station. The ratios of the depth of the catchment to the size of the box of the outlet pipe are selected so that the coolant is reliably conducted away from the cover in the slag-tapping phase without water collecting outside of the catchment.

The discharging system for the cooling water is designed so that not only the tilting motion of the cover, but also the lifting and swiveling out of the way of the cover is possible without interrupting the inflow and outflow of the coolant.

For this purpose, essential parts of the coolant piping system are formed from heavy duty hoses which can accommodate torsion and bending without damage. The hoses provided for this purpose are connected at one end with the cover outlet pipes and are rotatably supported at the other end on a swivel arm. When the cover is tilted, whether it be in the tapping direction or slag tapping direction, this tilting motion is carried out without shifting the swivel arm. When the cover is swiveled, the swivel arm is moved similarly with the motion of the bracket for the cover and thus enables the cover to be swiveled with the hoses attached. The motion of the tip of the swivel arm is, in turn, compensated for by an additional hose, which is connected over swiveling links with the final piping of the discharge line, which in turn is connected with the station, at which the coolant is transferred to the factory network. With proper sizing and the utilization of the geometric relationships described, that is, the arrangement of the swivel column and the length of the swivel arm, the cover, with the coolant supply connected, may be released and pivoted completely away from the furnace vessel.

For a better understanding of the invention and its attendant advantages, reference should be made to the accompanying drawings and the following detailed description.

BRIEF DESCRIPTION OF THE DRAWINGS

FIG. 2.1 is an enlarged cross-section of the roof;

FIG. 2.2 is section view showing details of the roof;

DETAILED DESCRIPTION OF A PREFERRED EMBODIMENT OF THE INVENTION

Figure 1:
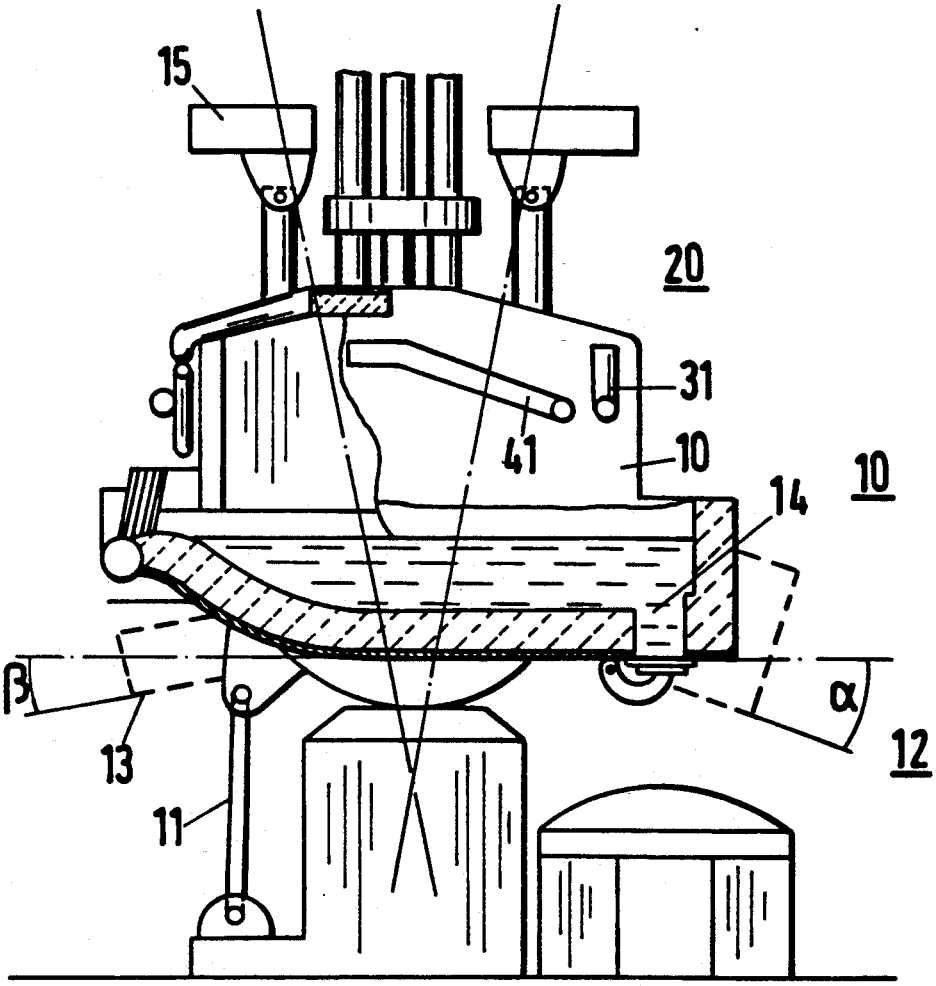
FIG. 1 is a overview, with parts broken away, of a furnace installation, embodying the invention.

FIG. 1 shows an overview of the furnace installation with a metallurgical vessel 10, which has a tilting mechanism 11, with which the vessel can be tilted either into the tapping position 12, with the taphole 14 lying low or into the slagging position 13 with the slag door lying low so that slag can be removed from the furnace in known fashion. The tilting angle for the tapping phase is labeled alpha and the tilting angle for the slagging phase is labeled beta. The metallurgical vessel 10 is closed with a hollow cover or roof 20 by a conventional roof lifting apparatus 15. The roof lifting apparatus 15 can be swung away from the furnace vessel 10 by the use of a cover turning column 16, (shown schematically in FIG. 4). In accordance with the invention, coolant outlet pipes 31 and 41 are disposed on the roof 20 for exhausting coolant by gravity when the roof is tilted for tapping (tapping outlet pipe 31) or when the roof is tilted for slagging (slagging outlet pipe 41)..

Figure 3:
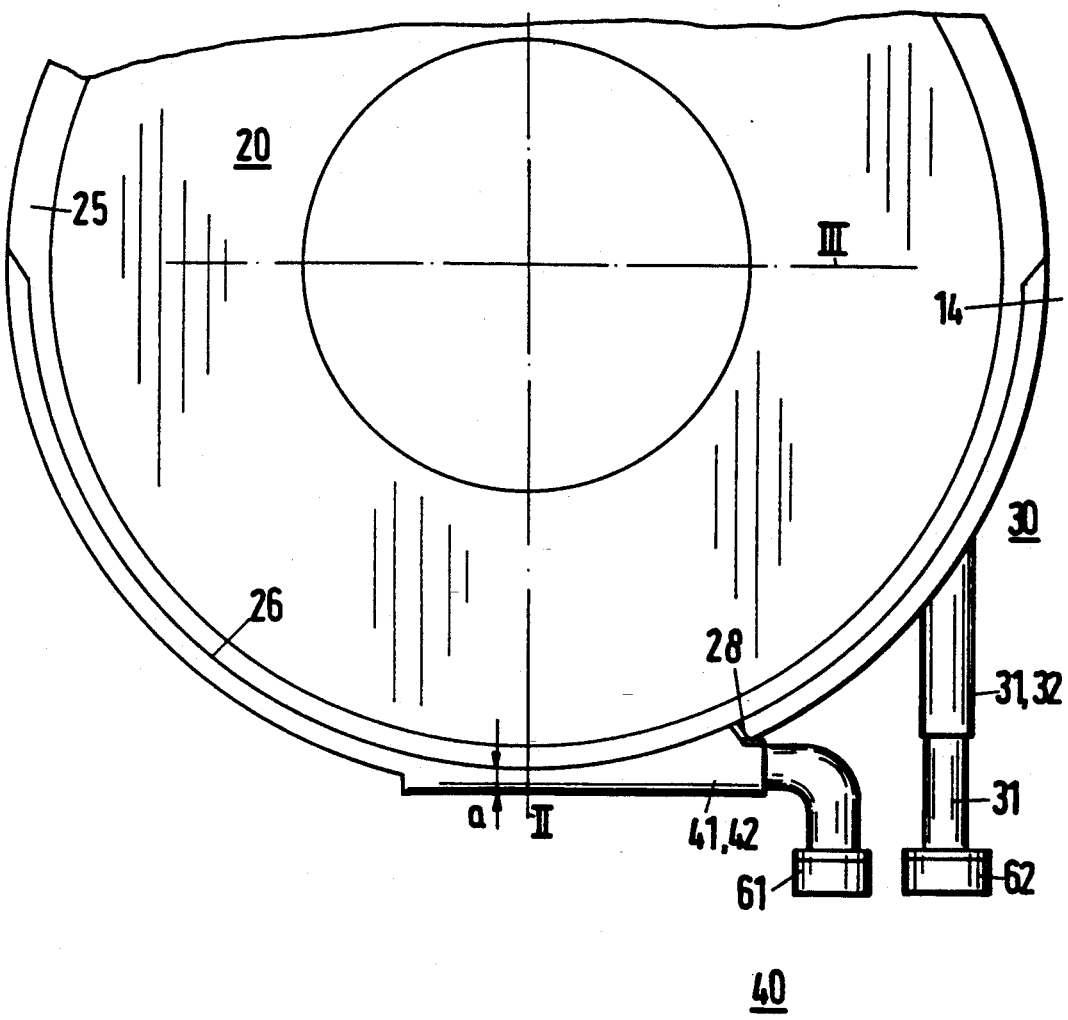
FIG. 3 is a plan view of the roof showing the exit lines.

FIGS. 2.1, 2.2 and FIG. 3 show dome-shaped the cover in section views and in a plan view respectively. The cover 20 has a lower wall 23 and an upper wall 24, between which are disposed spraying elements 21 for spraying coolant. The roof side wall 22 is constructed to include a catchment 25, within which there is a vertical partition 26 as well as a horizontal hood 27. The partition 26, the hood 27 and the roof side wall 22 combine to form an airtight coolant conduit 28, which extends from the tilt axis II in the direction of the taphole 14. A divider wall 28' separates the portions of the conduit which lead to the outlet lines 31, 41. Advantageously, the square pipe (42) extends over a range of 30 to 40 degrees of the circumference of the cover (20) and, moreover, at the periphery of the roof at the tilt axis (II), the pipe 42 is spaced at a distance "a" from the side wall (22) of the cover (20), corresponding to ⅓ the pipe diameter of the outlet line (40).

At right angles to the tilt axis of III, the coolant outlet line (tapping) 30 is integrated in the roof; the line 30 includes an outlet pipe 31, which is constructed as a square pipe 32 in the immediate area where it joins the cover 20. The outlet line 30 at an angle delta to the cover as shown in FIG. 2.2.

Tangentially to the edge of the roof 20 and starting in the region of the tilt axis II, a separate coolant outlet line (slagging) 40 is provided and which has an outlet pipe 41, which is constructed as a square pipe 42 where it joins the cover 20. The outlet line 41 is at an angle gamma (which is greater than the tilt angle of the vessel in slagging position) to the underside of the cover as shown in FIG. 2.1. Couplings 60, namely coupling elements 61 and 62, are provided at the ends of outlet pipes 31, 41 for connection with hoses 35, 45 respectively through mating coupling elements 64, 65. The coupling elements 64,65 must always be below the elements 61,62 to ensure gravity.

Figure 5:
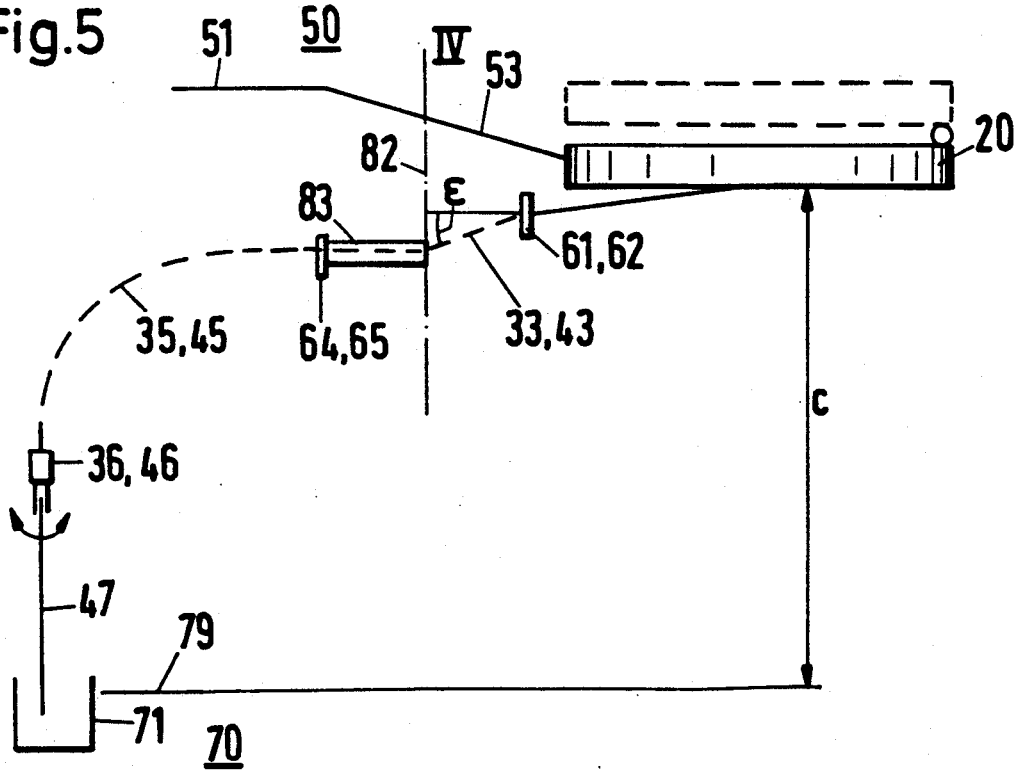
FIG. 5 is a schematic side view of the kinematics of swiveling the roof.

A coolant supply line 50, which consists of an inflow pipe 51 and an inflow hose 53 is associated with the cover 20, as indicated in FIG. 5 to supply liquid for spray cooling the roof's in known fashion.

Figure 4:
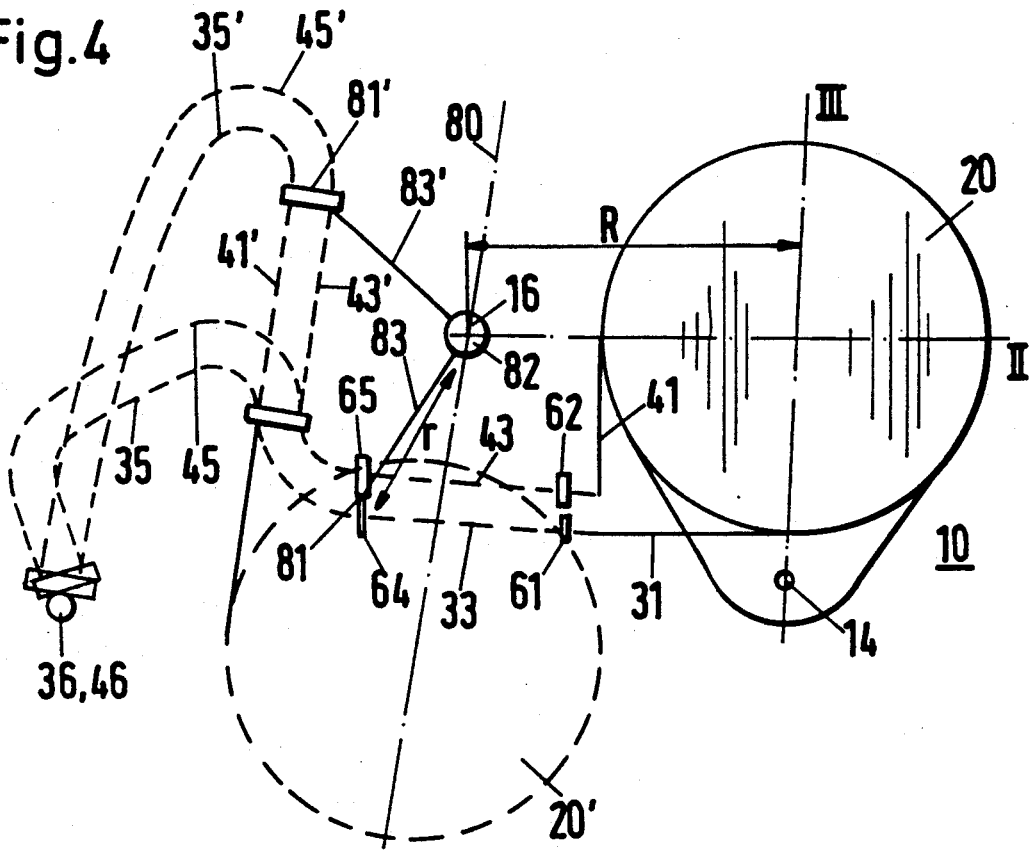
FIG. 4 is a schematic plan view of the kinematics of swiveling the roof.

FIGS. 4 and 5 show the kinematics of lifting and swiveling the roof in plan view and in side view, respectively. During the charging process, for example, the cover 20 is swiveled away from the vessel 10 in which the elements are indicated with prime designations into the position 20'. The outlet pipes 31 and 41, including the coupling pieces 61, 62 are moved along with the cover. If the cover turning column 16 is used as swiveling apparatus 80, this swiveling motion is also carried out by the swivel arm 83, so that the connecting hoses 33 and 43, as well as the coupling pieces 64 and 65 are swung along in synchronism at the same speed and the same angle. The connecting hoses 35, 45, which are disposed between the head end 81 of the swivel arm 83, and the swiveling links 36, 46 that are attached to discharge pipes 37, 47 of sufficient length to accommodate this motion. It is thus not necessary to break the hose connections when the cover is lifted and swiveled. Advantageously, the connecting hoses (33, 43) are disposed at an angle epsilon of 10 degrees to the horizontal. They are coupled to pipe sections (34, 44) that are disposed at the head end (81) of a swivel arm (83) of a swiveling apparatus (80); Also it is advantageous that the swivel column (82) is the cover turning column (16), at which the swivel arm (83) has a radius (r) of 0.5 to 0.8 of the distance (R) from the cover turning column (16) to the tilt axis III as shown in FIG. 4.

During the normal melting cycle of the furnace, cooling water is discharged equally from the pipes 41 and 31. However, during tapping, the coolant is discharged only through pipe 31. During slagging coolant is discharged only through the pipe 41.

The discharge pipe 47 runs into a transfer station 70, which has a transfer vessel 71 that is connected with the factory network 79. There is a sufficient elevation "c" of the roof 20 with respect to the transfer vessel 71 to ensure gravity flow and siphoning of the coolant from the roof taking all resistances into consideration.

It should be particularly understood that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A gravity drainable roof system for a metallurgical vessel having a roof tiltable from a horizontal operating position, at predetermined tilt angles, to a predetermined slagging position (13) or to a predetermined tapping position (12) about a tilt axis II, which roof may be lifted and swiveled, the roof including a circular upper part and a circular lower part the faces of which are parallel to one another; roof spray elements disposed between the said upper and lower parts and connected to a supply of coolant; a coolant outlet, and two outlet lines connecting said roof to a transfer station (71), wherein, (a) at the edge of the lower part (23) of the roof (20) a catchment (25) is provided;

(b) at the intersection with the tilting axis (II) of the roof (20) an outlet pipe (41) of an outlet line (40) is connected to the catchment;

(c) said outlet line (40) runs tangentially and at an angle gamma, which is greater than the tilt angle of the vessel in said predetermined slagging position, to the underside (23) of the cover (20) in a region of the part of the cover (20) which is inclined to a taphole (14), (d) an outlet pipe (31) which is parallel with the tilt axis (II) and makes an angle delta with the lower part (23) of the roof (20) is connected to the catchment;

(e) portions of the outlet pipes (31, 41) which are connected with the catchment (25) are constructed as square pipes (32, 42);

(f) the outlets of the pipes (31, 41) are structurally identical and are provided in spatial proximity to coupling elements (61, 62), to which connection hoses (33, 43) are coupled; and (g) said transfer station is disposed at a vertical distance sufficiently beneath the lowest position of the roof (20) when in a tilted position to ensure a reliable drainage of the coolant by gravity;

(h) whereby said coolant may be reliably removed from said roof by gravity suction alone.

2. The gravity drainable roof system of claim 1, wherein (a) at the apex of the catchment (25) a partition (26) cooperates with a hood (27) to form a conduit (28) at the side (22) of the roof (20), and (b) said conduit includes a wall (28') separating the coolant flowing to the outlet lines (30, 40), said lines having predetermined diameters.

3. The gravity drainable roof system of claim 1, wherein (a) a square pipe (42) portion extends 30 to 40 degrees of the circumference of the cover (20), and (b) the portion (42) is spaced a distance "a" from the edge (22) of the roof (20) corresponding to ⅓ the diameter of the outlet line (40) at the intersection with the tilt axis (II).

4. The gravity drainable roof system of claim 1, wherein (a) the outlets of the outlet pipes (31, 41) are spaced equidistantly from the longitudinal axis (III) of the cover and the lower part (23) of the roof (20).

5. The gravity drainable roof system of claim 1, wherein (a) a swiveling apparatus (80) with a swivel arm (83) for said roof is included; and (b) connecting hoses (33, 43) are disposed at an angle epsilon to the horizontal and said hoses are coupled with pipe sections (34, 44) disposed at the head end (81) of said swivel arm (83).

6. The gravity drainable roof system of claim 5, wherein (a) the swivel arm (83) has a swivel column (82) which is disposed outside of the furnace vessel (10) below the swiveling plane of the roof (20) in the region of the tilting axis (II) and is disposed spatially in such a manner that the roof (20) including the supply and outlet lines (30, 40, 50) may be freely swiveled.

7. The gravity drainable roof system of claim 6, wherein (a) the swivel column (82) is a roof turning column (16), at which the swivel arm (83) has a radius "r" of 0.5 to 0.8 of the distance "R" from the cover turning column (16) to the tilt axis III.

8. The gravity drainable roof system of claim 5, wherein (a) discharge lines (37, 47) communicate with said transfer station (71); and (b) connecting hoses (35, 45) are provided, which connect said pipe sections (34, 44) to said discharge lines (37,47).

9. The gravity drainable roof system of claim 8, wherein (a) swiveling links (36, 46) are disposed at the head end of said discharge lines (37, 47).

10. The gravity drainable roof system of line 1, wherein (a) coolant exhaust lines (30) (40) are provided at the cover and said lines are disposed parallel to one another and in the same plane in the area of connection to the connecting hoses (35, 45).

* * * * *